US005864954A

United States Patent [19]

Harrington

[11] Patent Number: 5,864,954

[45] Date of Patent: Feb. 2, 1999

[54] SLITTER TOOL

[75] Inventor: Eugene M. Harrington, Los Angeles, Calif.

[73] Assignee: Harrington Tools, Inc., Los Angeles, Calif.

[21] Appl. No.: 926,080

[22] Filed: Sep. 2, 1997

[51] Int. Cl.[6] ..... B26B 5/00

[52] U.S. Cl. ..... 30/324

[58] Field of Search ..... 30/162, 335, 329, 30/337–339; 411/531

[56] References Cited

U.S. PATENT DOCUMENTS 4,106,181 8/1978 Mattchen ..... 30/339 X 5,603,162 2/1997 Chen ..... 30/162

5,613,300 3/1997 Schmidt ..... 30/339 X

*Primary Examiner*—Douglas D. Watts

*Attorney, Agent, or Firm*—William W. Haefliger

[57] ABSTRACT

A slitting tool, comprising, in combination: a body defining a handle, there being an elongated slot in the body; a guide plate received in the slot; a metallic cutter blade received in the slot to face plate, the blade having a cutting edge protruding endwise of the slot and body; and a fastener received in the body and acting to clamp the blade, the fastener being adjustable to free the blade for endwise withdrawal from the slot.

11 Claims, 2 Drawing Sheets

FIG. 4.
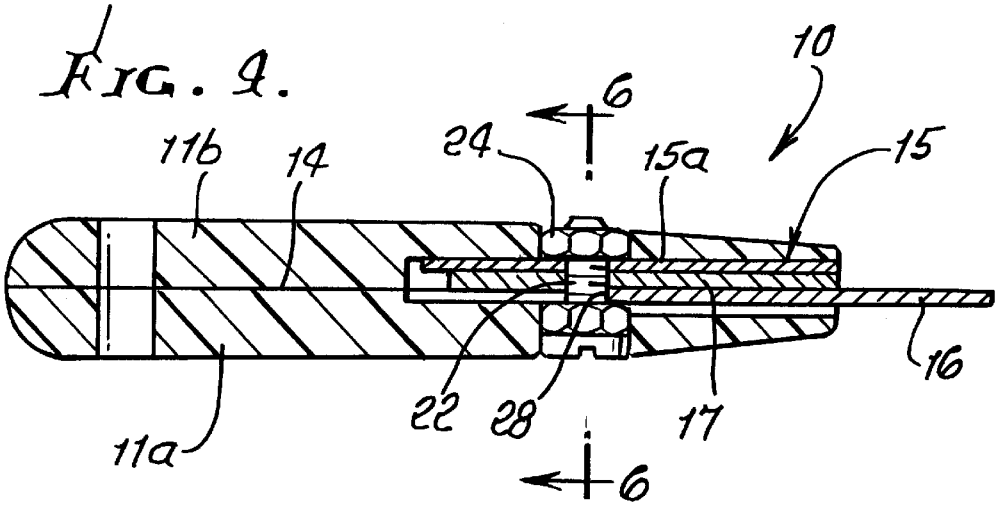
FIG. 5.
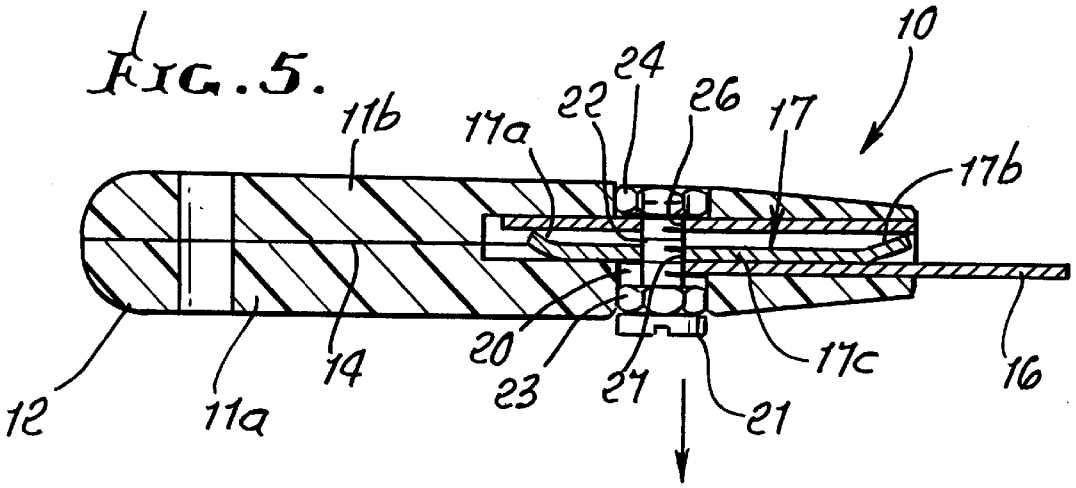
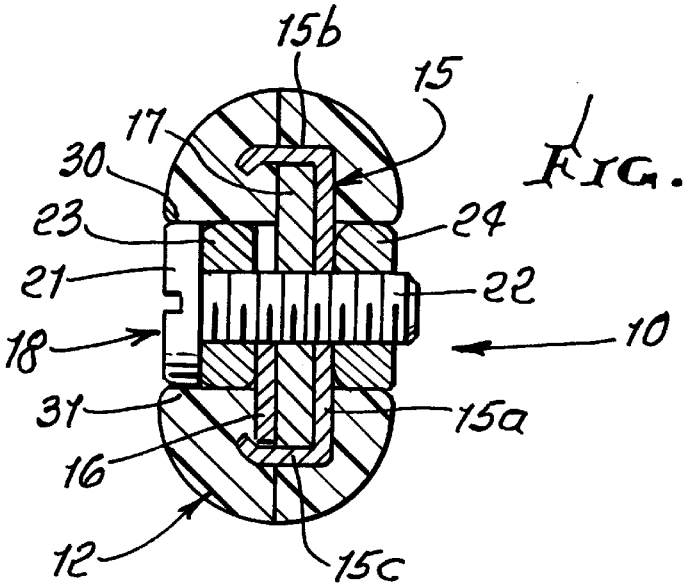
FIG. 6.

SLITTER TOOL

BACKGROUND OF THE INVENTION

This invention relates generally to slitting tools, and more particularly to manually grasped and operated slitters of the type used in carpentry, or for cutting packing boxes, or for many other applications.

There is continued need for reliable, rugged, easily operated slitters of the above type. There is also need for slitting devices having the unusually advantageous construction, and modes of use and operation characterized by the present tool.

SUMMARY OF THE INVENTION

It is a major object of the invention to provide an improved slitting tool meeting the above needs. Basically, the tool comprises:

a) a body defining a handle, there being an elongated slot in the body, b) a guide plate received in the slot, c) a metallic cutter blade received in the slot to face the plate, the blade having a cutting edge protruding endwise of the slot and body, d) a fastener received in the body and acting to clamp the blade, the fastener being adjustable to free the blade for endwise withdrawal from the slot.

It is another object to provide a guide plate that defines an endwise extending channel into which the blade is received. Typically, the blade is clamped toward a wall defined by the channel, and is positively peripherally and protectively confined by the channel, whereby it is tightly retained to the handle, as during slitting. The handle may consist of non-metallic material, such as molded plastic, and the blade and channel may consist of metal such as steel.

It is a further object to provide the channel to have two spaced flanges, the blade having two edges received endwise in the channel in proximity to the respective flanges.

Yet another object is to provide a clamping plate to be slightly bowed relative to the blade, the fastener when tightened causing the clamping plate to flatten and press sidewardly against the blade, thereby reducing the bowed condition of the plate for enhancing frictional sideward engagement of the blade and clamping plate. This in turn assures retention of blade in the slot, and enables blade endwise removal when the fastener is loosened. The clamping plate may consist of spring steel and is normally bowed prior to being clamped by the fastener.

An additional object is to provide a single fastener received in a side opening in the handle, whereby a very simple assembly is achieved, to clamp the blade, loosening of the fastener enabling endwise withdrawal of the blade from the channel.

These and other objects and advantages of the invention, as well as the details of an illustrative and preferred embodiment, will be more fully understood from the following specification and drawings, in which:

DRAWING DESCRIPTION

FIG. 4 is a longitudinal section taken on lines 4—4 of FIG. 2;

FIG. 5 is a view like FIG. 4 showing loosening of a fastener and resultant movement of tool internal parts; and FIG. 6 is an enlarged section taken on lines 6—6 of FIG. 4.

DETAILED DESCRIPTION

Figure 1:
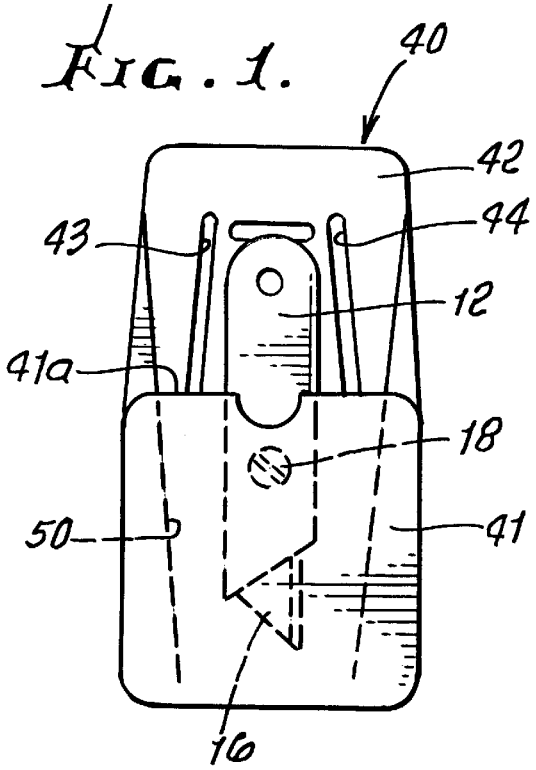
FIG. 1 is a side view of a case supporting the tool of the invention.
Figure 3:
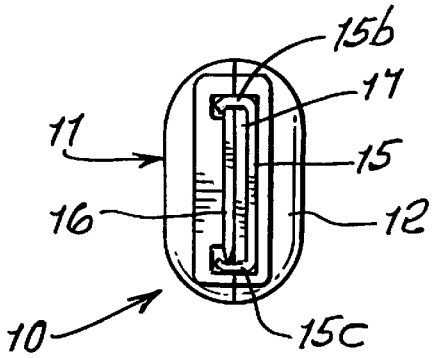
FIG. 3 is an end view taken on lines 3—3 of FIG. 2.

The slitter tool 10 as shown includes a body 11 defining a lengthwise extending handle 12. An elongated slot 13 is provided in the body. As shown in FIGS. 4 and 5, the body may comprise two halves 11*a* and 11*b* which are joined together as by a bonding agent at interface 14, the slot 13 extending at opposite sides of the interface.

Figure 2:
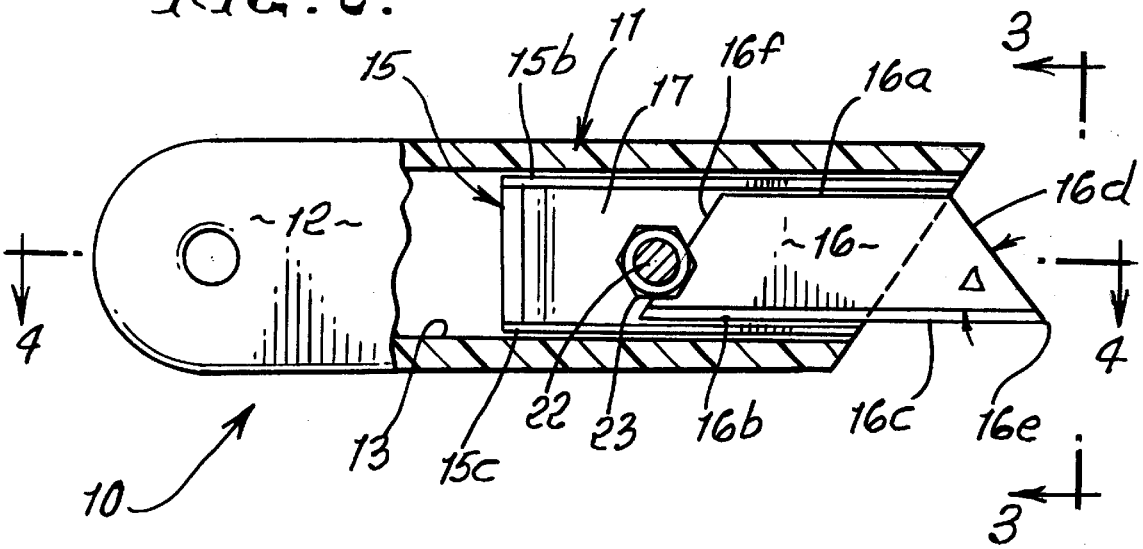
FIG. 2 is a side elevation, partly in section, showing tool construction.

A metallic guide plate 15 in the form of a channel is received endwise in the slot. That channel defines a side wall 15*a* and two spaced flanges 15*b* and 15*c* at upper and lower ends of the wall 15*a*. Terminal ends of the flanges may be turned to retain edges of a blade 16. Metallic cutter blade 16 is also received endwise in the slot, and in the channel, to sidewardly face toward the wall 15*a*. Upper and lower edges of the blade at 16*a* and 16*b* are bridged by the flanges 15*b* and 15*c* as seen in FIG. 6. The blade has a cutting edge 16*c* which extends lengthwise as seen in FIG. 2 to project from within the channel to the exterior. The blade also has a forward edge 16*d* extending at an acute angle relative to edge 16*c*, whereby a sharp point 16*e* is terminally formed by edges 16*c* and 16*d*. Cutting edge 16*c* protrudes endwise of the slot and body 11.

Also received in the channel between the blade 16 and side wall 15*a* is a spring plate 17, which is slightly bowed relative to wall 15*a* prior to clamp-up of the elements, as by tightening of a fastener 18 described below. The bowed ends of plate 17 are indicated at 17*a* and 17*b* in FIG. 5. The medial extent 17*c* of the spring plate extends flatly adjacent the side surface of the blade, forwardly of fastener 18 and the full length of the spring plate 17 extends forwardly and rearwardly of the fastener, facing wall 15*a* as shown. Upon tightening of fastener 18, the spring plate is deformed as for example to the shape seen in FIG. 4, with the opposite ends 17*a* and 17*b* exerting frictional force against wall 15*a*, whereby spring reaction force is developed between the medial extent 17*c* of the plate and the blade side engaged by the plate, forwardly of the fastener. This serves to positively retain the blade in position by force application along substantial length of the blade side, preventing inadvertent withdrawal of the blade from the body 11 as during slitting of work such as cardboard boxes, plastic sheets, and the like. It will be noted that the blade may be endwise withdrawn when the fastener is loosened, as in FIG. 5, since the fastener does not pass through the blade. Blade angled edge 16*f* engages the fastener shank, which acts as a stop, to position the blade.

Fastener unit 18 as referred to is received in the body and acts to clamp the blade sidewardly relative to the plate 17 and channel side wall 15*a*, to maintain the blade in position as referred to. Further, the fastener unit is adjustable to free the blade for endwise withdrawal from the channel 15, as for replacement. As shown, the handle defines a side opening 20 through the handle, and the fastener unit is received in that side opening. The fastener unit may include a rotatable head 21, a reduced diameter threaded shank 22, and internally threaded non-rotary nuts 23 and 24 positioned as shown. Nut 23 bears against the side of the blade, and nut 24 bears against channel side wall 15*a*. Threaded shank 22 extends through aligned openings 26 and 27 in side wall 15*a* and in plate 17. Blade 16 bears against shank 22 at 28. Upon tightening, nut 23 is displaced toward nut 24, displacing the blade and plate 17 toward wall 15*a*. The fastener unit 18 is substantially retained between opposite outer sides 30 and 31 of the handle to prevent interference with the user's hand. The portions of the opening 20 receiving nuts 23 and 24 are typically hexagonal to hold nuts 23 and 24 against rotation. Fastener head 21 is typically cylindrical to allow its rotation, as during clamp-up and loosening. See FIG. 2.

Referring to FIG. 1 it shows the slitter 10 received downwardly in a case 40, with the handle 12 projecting above a case front wall 41. The case back wall 42 extends above the level 41*a* of wall 41, and a pocket 50 is formed between 41 and 42 to receive the blade edge. Back wall 42 contains slots 43 and 44 to pass a belt worn by the user for supporting the case.

In the above, elements 15, 16 and 17 preferably consist of steel.

It will be seen that the blade is preferably trapezoidal in outline, to extend forwardly from the fastener 18, from abutting relation to the fastener.

I claim:

1. A slitting tool, comprising, in combination:

a) a body defining a handle, there being an elongated slot in said body, b) a guide plate received in said slot, c) a metallic cutter blade received in said slot to face the plate, the blade having a cutting edge protruding endwise forwardly of said slot and body, d) a fastener received in said body and acting to clamp said blade, the fastener being adjustable to free the blade for endwise withdrawal from the slot, e) a clamping plate received between the blade and a wall defined by the guide plate, f) said handle having a side opening, passing said fastener to urge the blade toward the clamping plate.

2. The combination of claim 1 wherein said guide plate defines an endwise extending channel into which said blade is endwise received.

3. The combination of claim 1 wherein the blade is clamped toward a wall defined by the channel, to be positively peripherally confined by the channel.

4. The combination of claim 2 wherein said channel has two spaced flanges, and said blade has two edges received endwise in proximity to said respective flanges.

5. A slitting tool, comprising, in combination:

a) a body defining a handle, there being an elongated slot in said body, b) a guide plate received in said slot, c) a metallic cutter blade received in said slot to face the plate, the blade having a cutting edge protruding endwise forwardly of said slot and body, d) a fastener received in said body and acting to clamp said blade, the fastener being adjustable to free the blade for endwise withdrawal from the slot, e) a clamping plate received between the blade and a wall defined by the guide plate, f) and wherein the clamping plate is slightly bowed relative to the guide plate, said fastener urging the blade sidewardly against the clamping plate, thereby reducing said bowed relation and enhancing frictional engagement of the blade and clamping plate.

6. The combination of claim 5 wherein opposite ends of the clamping plate are bowed endwise oppositely of the fastener, the blade subtending only one of said bowed opposite ends.

7. A slitting tool, comprising, in combination:

a) a body defining a handle, there being an elongated slot in said body, b) a guide plate received in said slot, c) a metallic cutter blade received in said slot to face the plate, the blade having a cutting edge protruding endwise forwardly of said slot and body, d) a fastener received in said body and acting to clamp said blade, the fastener being adjustable to free the blade for endwise withdrawal from the slot, e) a clamping plate received between the blade and a wall defined by the guide plate, f) and wherein said clamping plate has bowed extent, which is reduced as said fastener means is tightened, said clamping plate initially contacting the blade along medial extent of the clamping plate.

8. The combination of claim 7 wherein said handle has a side opening, passing said fastener to urge the blade toward the clamping plate.

9. The combination of claim 3 wherein the handle is non-metallic, and the blade and channel consist of steel.

10. A slitting tool, comprising, in combination:

a) a body defining a handle, there being an elongated slot in said body, b) a guide plate received in said slot, c) a metallic cutter blade received in said slot to the face plate, the blade having a cutting edge protruding endwise forwardly of said slot and body, d) a fastener received in said body and acting to clamp said blade, the fastener being adjustable to free the blade for endwise withdrawal from the slot, e) a clamping plate received between the blade and a wall defined by the guide plate, f) and wherein said fastener means includes a fastener shank extending through the clamping plate, and guide plate, and also includes non-rotary nuts engaging the guide plate and blade located between the nuts.

11. The combination of claim 1 wherein the blade is substantially trapezoidal in edge shape, to extend forwardly from the fastener, from abutting relation therewith.

* * * * *